US009334762B2

(12) United States Patent
Kuffner et al.

(10) Patent No.: US 9,334,762 B2
(45) Date of Patent: May 10, 2016

(54) CAMSHAFT ADJUSTER

(71) Applicant: Magna Powertrain AG & Co KG, Lannach (AT)

(72) Inventors: Felix Kuffner, Linz (AT); Michael Schober, Behamberg (AT)

(73) Assignee: Magna Powertrain AG & Co KG, Lannach (AT)

( * ) Notice: Subject to any disclaimer, the term of this patent is extended or adjusted under 35 U.S.C. 154(b) by 0 days.

(21) Appl. No.: 14/397,656

(22) PCT Filed: Mar. 21, 2013

(86) PCT No.: PCT/EP2013/055986
§ 371 (c)(1),
(2) Date: Oct. 29, 2014

(87) PCT Pub. No.: WO2013/164129
PCT Pub. Date: Nov. 7, 2013

(65) Prior Publication Data

US 2015/0152751 A1 Jun. 4, 2015

(30) Foreign Application Priority Data

May 3, 2012 (DE) ..... 10 2012 207 318

(51) Int. Cl.
*F01L 1/34* (2006.01)
*F01L 1/344* (2006.01)
*F01L 1/352* (2006.01)

(52) U.S. Cl.
CPC *F01L 1/344* (2013.01); *F01L 1/352* (2013.01)

(58) Field of Classification Search
CPC ..... F01L 1/344; F01L 1/352
USPC ..... 123/90.15, 90.17, 90.31
See application file for complete search history.

(56) References Cited

U.S. PATENT DOCUMENTS 7,032,552 B2 * 4/2006 Schafer ..... F01L 1/024 123/90.11
7,451,731 B2 * 11/2008 Eichenberg ..... F01L 1/352 123/90.15

FOREIGN PATENT DOCUMENTS

DE 20003955 U1 8/2000
DE 10248355 A1 4/2004
DE 10332264 A1 2/2005

(Continued)

OTHER PUBLICATIONS

PCT/EP2013/055986, International Search Report mailed Jun. 13, 2013.

*Primary Examiner* — Ching Chang
(74) *Attorney, Agent, or Firm* — Dickinson Wright PLLC

(57) ABSTRACT

A camshaft adjuster for an internal combustion engine is composed of an adjusting gear designed as a triple-shaft gear, with a drive wheel which is driven from the internal combustion engine and via which the drive torque for the camshaft is introduced, of a gear output coupled fixedly in terms of rotation to the camshaft, and of a gear input wheel which is coupled to a drive motor and via which the adjusting torque causing the relative rotation between the drive wheel and gear output is introduced into the adjusting gear. The cam adjuster includes a failsafe mechanism which causes blocking of the adjusting gear and which, in the event of the absence of an adjusting torque to be introduced via the gear input wheel, acts upon a gear element located between the drive wheel and gear output.

18 Claims, 9 Drawing Sheets

(56) References Cited

FOREIGN PATENT DOCUMENTS

| | | | |
|---|---|---|---|
| DE | 10352255 | A1 | 6/2005 |
| DE | 102004033894 | A1 | 2/2006 |
| DE | 102005018956 | A1 | 11/2006 |
| DE | 102006028554 | A1 | 1/2008 |
| DE | 102010021783 | A1 | 12/2011 |
| DE | 102010039426 | A1 | 2/2012 |
| EP | 1504172 | A1 | 2/2005 |
| JP | 2007512460 | A | 5/2007 |
| JP | 2011226344 | A | 11/2011 |
| WO | 2006027131 | A1 | 3/2006 |

* cited by examiner

CAMSHAFT ADJUSTER

CROSS-REFERENCE TO RELATED APPLICATIONS

This application is a National Stage of International Application No. PCT/EP2013/055986 filed Mar. 21, 2013 which claims the benefit and priority of German Patent Application No. DE 102012207318.3 filed on May 3, 2012. The entire disclosure of each of the above applications is incorporated herein by reference.

TECHNICAL FIELD

The invention relates to a camshaft adjuster for an internal combustion engine, composed of an adjusting gear designed as a triple-shaft gear, with a drive wheel which is driven from the internal combustion engine and via which the drive torque for the camshaft is introduced, of a gear output coupled fixedly in terms of rotation to the camshaft, and of a gear input wheel which is coupled to a drive motor and via which the adjusting torque causing the relative rotation between the drive wheel and gear output.

BACKGROUND

An electrical camshaft adjuster of an internal combustion engine is known from DE 10 2005 018 956 A1 or DE 102 48 355 A1. The camshaft is driven in semi revolution from the crankshaft, for which purpose a camshaft drive wheel of the camshaft is coupled to the crankshaft. An adjusting gear between the camshaft and camshaft drive wheel makes it possible to adjust the phase position of the camshaft drive wheel and camshaft. The adjusting gear may be designed, for example, as a double planetary gear or as a harmonic drive gear.

DE 103 52 255 A1 shows a camshaft adjuster with an adjusting drive designed as a triple-shaft gear. The electric motor is arranged separately in space from the adjusting shaft of the adjusting gear—the adjusting torque is transmitted by means of a flexible shaft.

In the event of failure of the activation electronics and/or of the electric motor, the camshaft adjuster must bring the camshaft into a neutral position or into an emergency running position, and this relative rotation defined in this way between the camshaft drive wheel and the camshaft must be maintained in order to continue to operate the internal combustion engine or so that it can be operated again after being stopped.

EP 1 504 172 B1 describes a camshaft adjuster in which, in the event of failure of the servomotor, it exerts a braking action (that is to say, looses rotational speed with respect to the camshaft drive wheel) and thus causes an end position, a failsafe position, to be assumed. The maximum advance or retard position of the camshaft is therefore assumed. It is not described how the camshaft is held in this position. Nor are any measures provided if the servomotor, in the event of failure or in the event of failure of the activation electronics, generates only insignificant braking torque. In these cases, the failsafe position is sometimes not reached or there is no assurance that the camshaft remains in the failsafe position or leaves this position in an uncontrolled way.

PCT/EP2011/050861 shows a camshaft adjuster with a bias spring which presses the camshaft adjuster back into a corresponding end position (maximum advance position or maximum retard position of the camshaft). This spring is active over the entire range of adjustment, although this is not advantageous in terms of energy consumption. If in the event of failure, the electric adjusting motor generates a correspondingly high braking torque (for example, due to a short circuit in the winding), the desired limit stop cannot be reached by means of a return spring of this type.

DE 103 32 264 A1 describes a failsafe system of a camshaft adjuster which has displaceable mechanical limit stops. These limit stops are prestressed in one direction in each case by means of a spring, in such a way that they correspondingly reduce the range of adjustment in the direction of the failsafe position, that is to say the maximum retard or advance position of the camshaft adjuster is reduced. During fault-free normal operation, these displaceable stops are blocked by means of a mechanical device, so that the entire range of adjustment of the camshaft adjuster can be utilized.

SUMMARY

The object of the present invention is to propose a camshaft adjuster in a version which is improved, as compared with the known solutions, and, in particular, with a failsafe system implemented simply in structural terms.

A failsafe mechanism is to be provided which is constructed in a very simple way, that is to say, as far as possible, requires no additional actuator. Furthermore, the solution should as far as possible have no influence upon the normal operation of the camshaft adjuster or upon the design of the latter for normal operation. The failsafe mode should be capable of being deactivated, that is to say returned to normal operation, only by a control of the adjusting motor which has become possible again. Finally, this mechanism should require little construction space or should utilize construction space which is already present.

The invention provides a camshaft adjuster for an internal combustion engine, composed of an adjusting gear designed as a triple-shaft gear, with a drive wheel which is driven from the internal combustion engine and via which the drive torque for the camshaft is introduced, of a gear output coupled fixedly in terms of rotation to the camshaft, and of a gear input wheel which is coupled to a drive motor and via which the adjusting torque causing the relative rotation between the drive wheel and gear output is introduced into the adjusting gear, there being provided a failsafe mechanism which causes blocking of the adjusting gear and which, in the event of the absence of an adjusting torque to be introduced via the gear input wheel, acts upon a gear element located between the drive wheel and gear output.

Thus, for the camshaft adjustment in accordance with the invention, the adjusting gear has provided in it a blocking or inhibiting device which, when a specific phase position of the camshaft adjuster, that is to say of the camshaft with respect to its drive wheel, is reached, blocks or inhibits the adjusting gear in this position against further adjustment.

This blocking or inhibiting device in accordance with the invention acts in a blocking way between the drive wheel and the gear output, that is to say that part of the adjusting gear which is fixed with respect to the camshaft. In accordance with the invention, the blocking or inhibiting device acts upon a gear part lying between the drive wheel and the gear output. The further gear part is in this case preferably a stepped-up element of the gear, for example the gear input shaft, the gear input wheel or a planet wheel. The necessary forces for such a blocking or inhibiting device can therefore be markedly reduced.

In particular, it is thereby possible to produce such a device in plastic.

The blocking or inhibiting device, when activated, blocks the adjusting gear against rotational release until a certain breakaway torque is reached. The breakaway torque of the device is designed such that the adjusting gear does not move away from the failsafe position in spite of the alternating torques prevailing on the camshaft, of the moments of friction on the adjusting motor and of the moments of inertia of the adjusting motor which take effect in the event of changes of rotational speed.

The inhibiting device in accordance with the invention is designed, in particular, in such a way that it can be activated essentially without additional torques. When the adjusting gear is actuated and the angle of adjustment of the camshaft reaches the corresponding position in which the inhibiting device is to be activated, in this region there is almost no additional torque required in order to activate the inhibiting device. If this position is to be left again, only a specific minimum breakaway torque is necessary for this purpose. This can be applied in a directed way by the adjusting motor.

Furthermore, the blocking device may be designed in such a way that the adjusting motor cannot by its own force unlock the blocking device. Unlocking then has to take place, for example, manually in a workshop.

The necessary breakaway torque may also differ in magnitude as a function of direction.

It is likewise possible, as a development, that the necessary breakaway torque is designed as a function of the rotational speed. It is thus possible that the mechanism is exposed to the rotational speed-dependent centrifugal force occurring as a result of the camshaft rotational speed. The design of this device may therefore be such that the required break away torque rises or falls with a rising camshaft rotational speed.

The blocking or inhibiting device may be activated with the aid of a magnet. In this case, a permanent magnet may be attached to the camshaft drive wheel or to the camshaft-fixed part of the adjusting gear. In a specific position of the adjusting gear, the distance of the permanent magnet from the further gear part becomes minimal or the permanent magnet comes into contact with the latter. If this specific angular position of the adjusting gear is to be left again, a specific breakaway torque is required, so that the distance between the permanent magnet and the corresponding gear part can be increased again. In all other angular positions of the adjusting gear, the distance of the permanent magnet from the corresponding gear part is such that the magnetic force is negligible and no additionally necessary adjusting torques are required. An additional actuator can unlock the blocking device again.

DRAWINGS

The drawings described herein are for illustrative purposes only of a selected embodiment and are not intended to limit the scope of the invention to that shown. In the drawings.

DESCRIPTION

Furthermore, an exemplary embodiment of the invention is described by means of the drawings.

Figure 1:
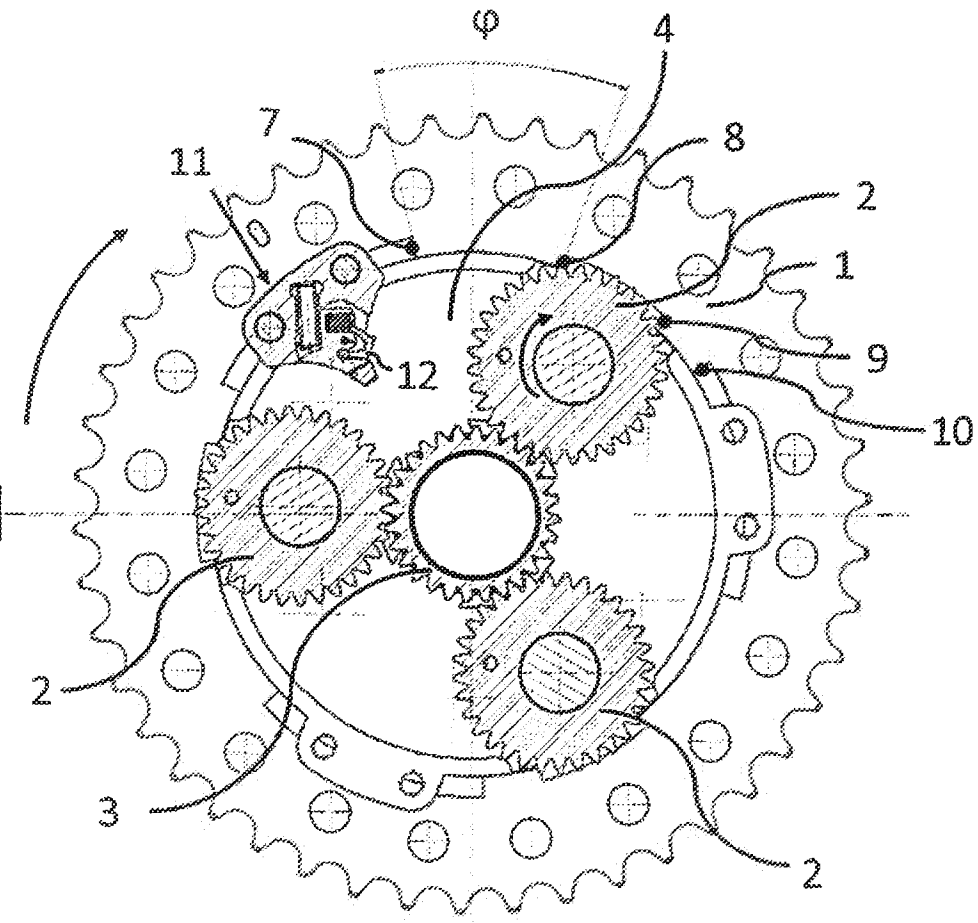
FIG. 1 is an end view of a camshaft adjuster equipped with a failsafe mechanism in accordance with the invention.

FIG. 1 illustrates a top view of a camshaft adjuster known per se, composed of a drive wheel 1 which is driven by the internal combustion engine, not illustrated. In the exemplary embodiment illustrated, the drive wheel 1 is designed as a chain wheel and is driven in semi-revolution via a chain from a crankshaft. The drive wheel 1 may also be designed as a toothed pulley which cooperates with a corresponding toothed belt. The direction of rotation of the drive wheel 1 and therefore that of the camshaft are identified by the arrow.

Figure 1A:
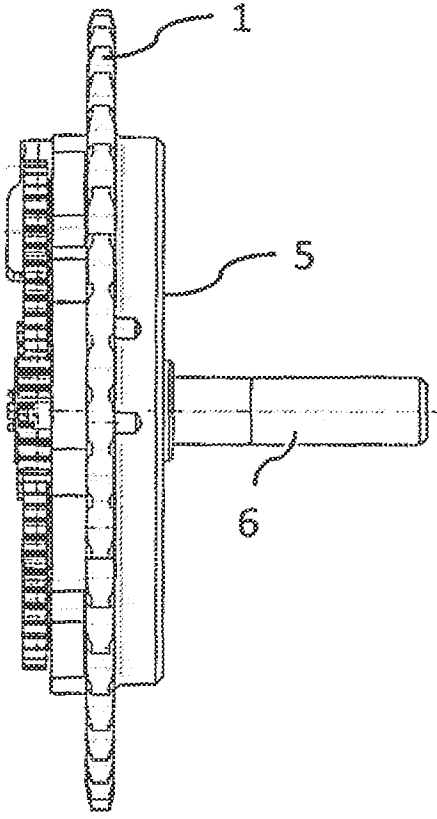
FIG. 1A is a side view of the camshaft adjuster shown in FIG. 1.

The drive wheel 1 is coupled by means of an internal toothing, not illustrated, which by a main gear which is driven, in turn, via three gearwheels 2 which are arranged in the manner of planet wheels around a centrally arranged gearing input wheel 3 and are in engagement with the latter. The gearwheels 2 arranged in the manner of planet wheels around the gear input wheel 3 are mounted in an axially fixed manner on tenons of a carrier plate 4 which is connected (central screw 6) fixedly in terms of rotation to the gear output 5, that is to say the camshaft or an intermediate member to the camshaft. FIG. 1*a*) illustrates a side view of the adjusting gear with a central screw 6 for the rotationally fixed connection of the gear output 5 to the camshaft (not illustrated), to the drive wheel 1 rotatable with respect to the gear output 5, to the gear input wheel 3 and to the gearwheels 2 arranged around the gear input wheel 3. The adjusting of the gear output 5 (camshaft) with respect to the drive wheel 1 takes place by the introduction of an adjusting torque from an adjusting motor (electric motor), not illustrated, to the central gear input wheel 3.

FIG. 1 illustrates various stops 7, 8, 9, 10 which define the maximum rotatability of the gear output 5, of the camshaft and of the drive wheel 1 with respect to one another, that is to say, ultimately, the maximum advance position and the maximum retard position of the camshaft. The drive-side limit stop 7 limits the maximum backward setting of the gear output 5, of the camshaft with respect to the drive wheel 1, that is to say the maximum retard position of the camshaft, in that the limit stop 7 cooperates with a camshaft-side limit stop 8. The phase angle $\phi$ corresponds to the relative angle between the drive wheel 1 and the gear output 5, the camshaft.

A limit stop 9 fixed on the camshaft side cooperates with a drive-side limit stop 10 and thus defines the maximum forward setting, that is to say the maximum advance position of the camshaft.

FIG. 1 finally illustrates the failsafe mechanism 11 in accordance with the invention in the form of a blocking device which cooperates with one of the gearwheels 2 in a way yet to be described. The blocking device of the failsafe mechanism 11 is attached by means of fastening screws to the drive wheel 1 and is thus connected to the latter fixedly in terms of rotation. In the exemplary embodiment illustrated, the failsafe mechanism 11 is assigned to the upper of the three gearwheels 2 illustrated in the figures.

Figure 2:
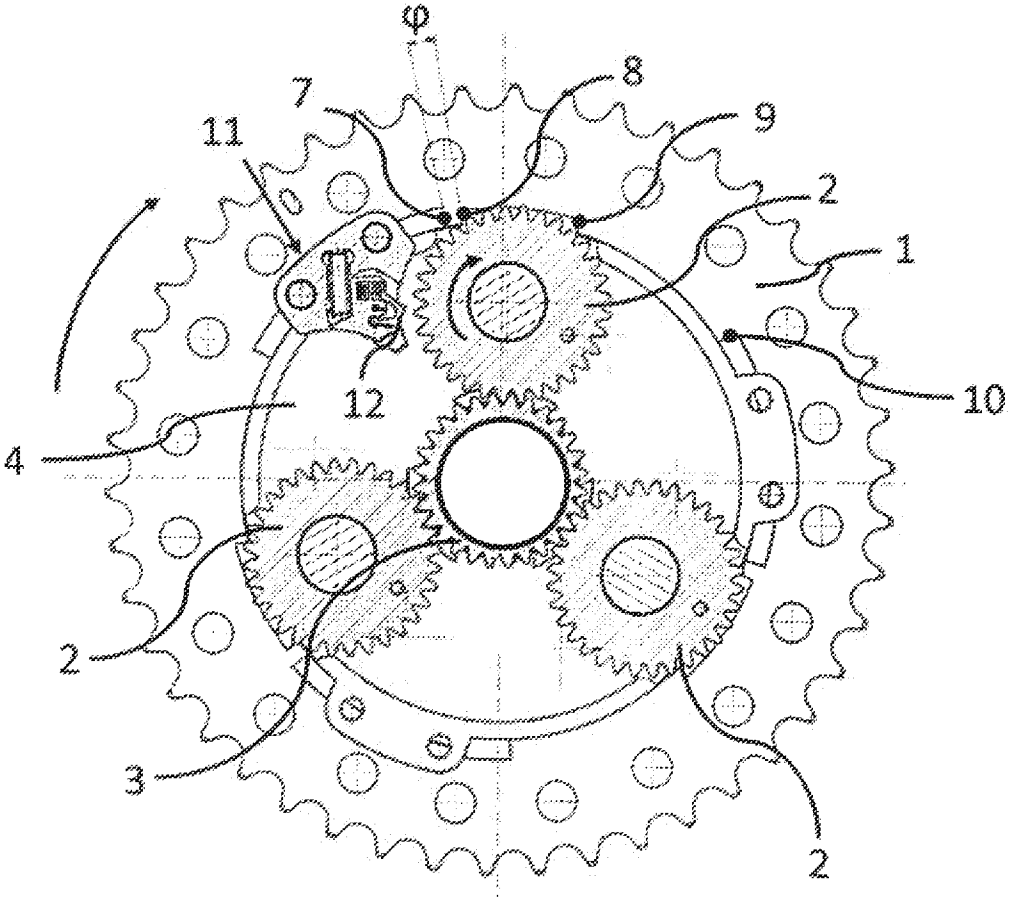
FIG. 2 is an end view similar to FIG. 1 but showing the camshaft adjuster with a gear output rotated relative to a drive wheel to establish a reduced phase angle therebetween.

FIG. 2 illustrates a relative rotation of the drive wheel 1 with respect to the gear output 5, that is to say to the camshaft, in the direction of the maximum retard position. This rotation is caused by the introduction of a corresponding adjusting torque via the central gear input wheel 3, with the result that the gearwheels 2 have been rotated in the direction of the directional arrow illustrated and have generated the relative rotation via the internal toothing of the drive wheel 1. In this position near the maximum retard position of the camshaft, the gearwheel 2 illustrated at the top in each of the figures has approached the failsafe mechanism 11. The associated phase angle ϕ between the drive wheel 1 and the gear output 5 has decreased, as compared with that in FIG. 1.

In the event of further rotation of the gear output 5 with respect to the drive wheel 1, the tip region of the gearwheel 2 comes into contact with a pivotably mounted detent pawl 12 of the failsafe mechanism 11. The shaping and pivot mounting of the detent pawl 12 are such that this is pressed in in the free-moving direction by the gearwheel 2 rotating in the direction of the arrow and causing adjustment of the camshaft in the direction of the maximum retard position, that is to say the detent pawl does not impede the rotation of the gearwheel 2 in this direction of rotation. The camshaft can thus be moved into the maximum retard position—the failsafe mechanism 11 with the detent pawl 12 is assigned to exactly this position.

Figure 3:
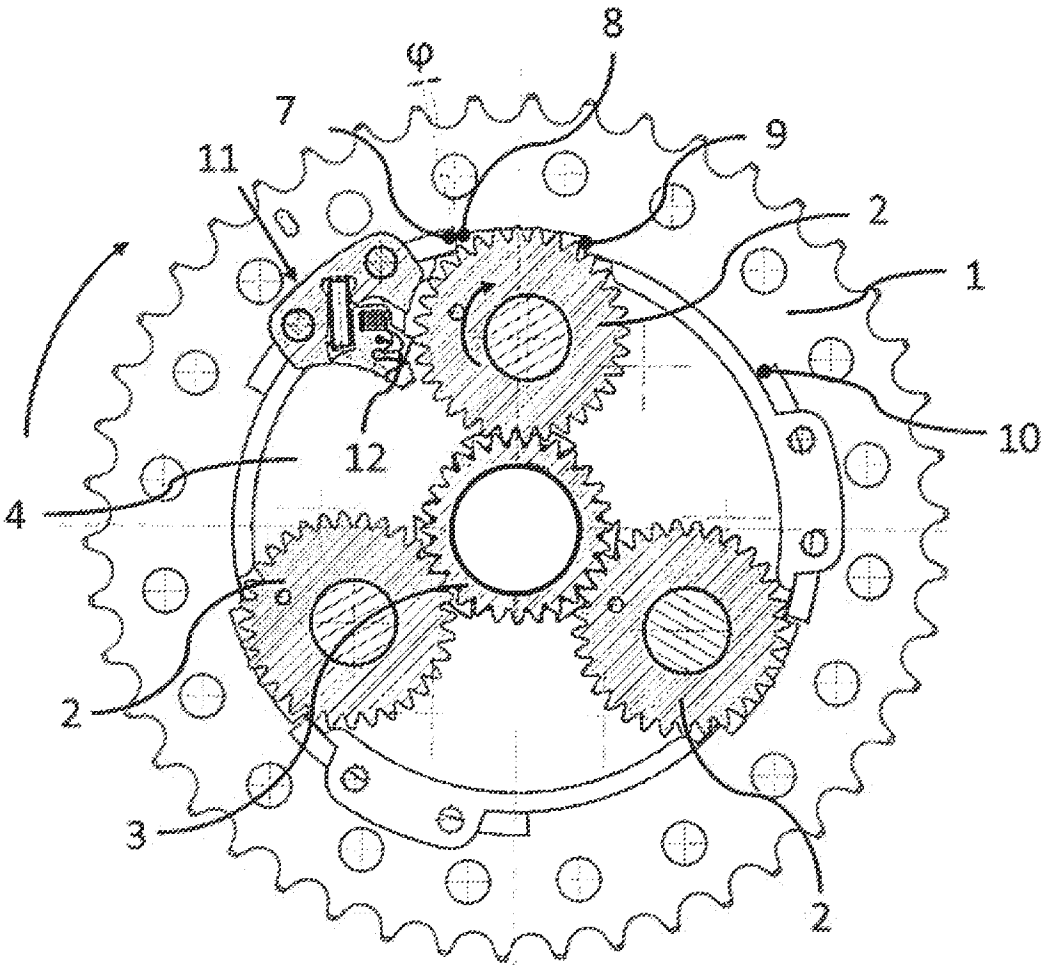
FIG. 3 is an end view also similar to FIGS. 1 and 2 showing further relative rotation between the gear output and the drive wheel resulting in initial engagement between a pivotable detent pawl of the failsafe mechanism and a gearwheel.
Figure 4:
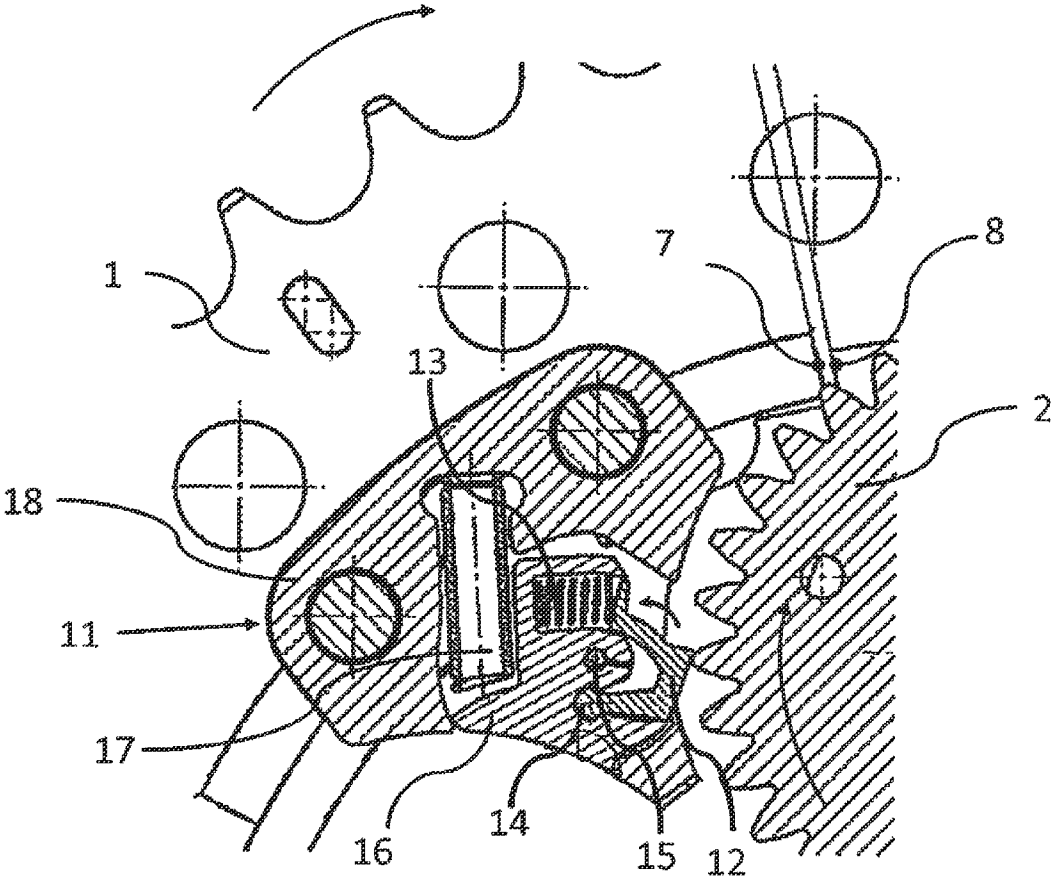
FIGS. 4 through 7 are a sequential series of partial enlarged views of the pivotable detent pawl of the failsafe mechanism and the gearwheel as the detent pawl moves into a blocking position.
Figure 5:
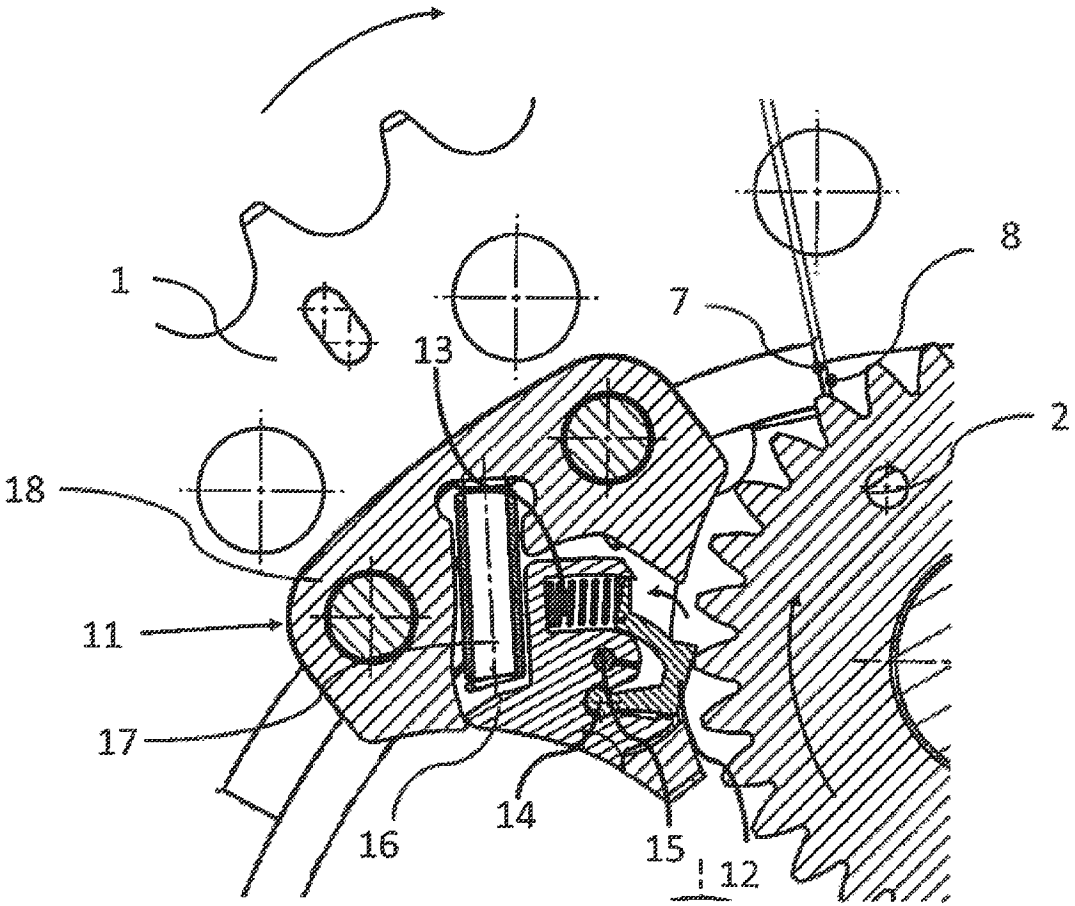
Figure 6:
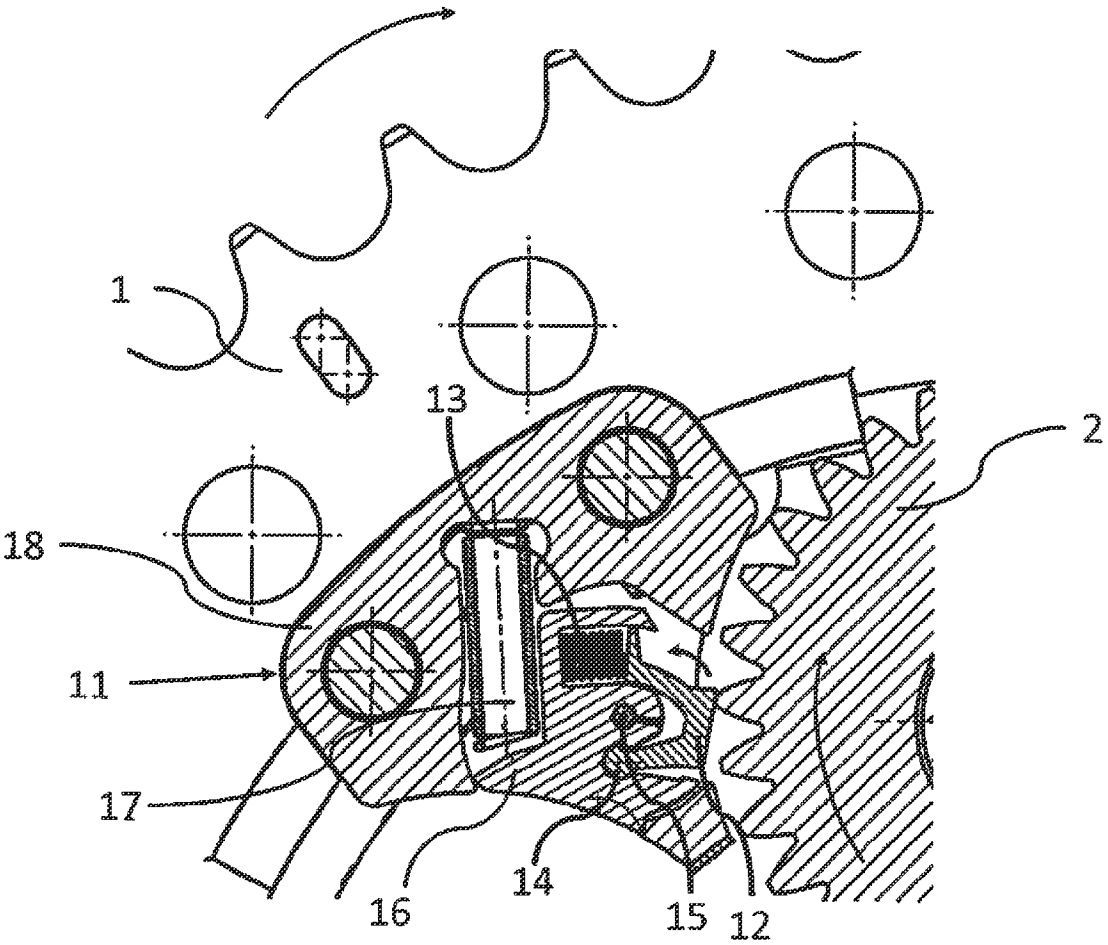

FIG. 3 and the enlarged illustrations of FIGS. 4-6 of the failsafe mechanism 11 illustrate how the pivotably mounted detent pawl 12, which is tensioned in the blocking direction (here clockwise) by the force of a compression spring 13, gives way to the teeth of the gearwheel 2 rotating in the direction of the arrow, that is to say does not impede rotation.

FIGS. 4-9 illustrate that the detent pawl 12 has its pivot bearing 14 in a bearing part 16 which is mounted about a further pivot axis 15 (parallel to the pivot bearing 14) and which is prestressed counterclockwise by a further compression spring 17. The compression spring 17 is in this case supported on a base part 18 which has the pivot bearing 15 for the bearing part 16 and which therefore carries the parts of the failsafe mechanism 11 which are described.

FIGS. 4-6 illustrate how the detent pawl 12 is pivoted counterclockwise by the gearwheel 2 rotating in the direction of the arrow—this direction of rotation causes the maximum retard position to be assumed.

Figure 7:
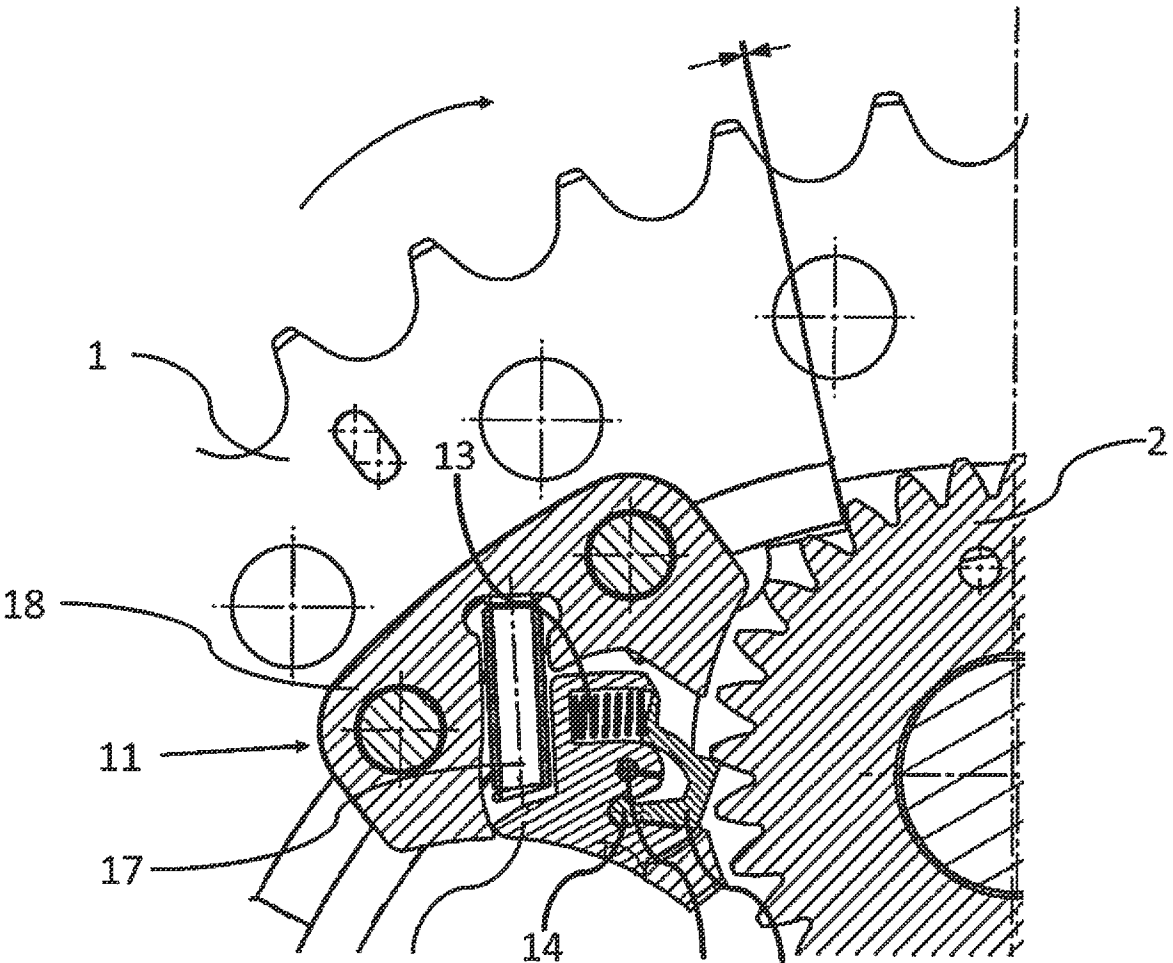

FIG. 7 illustrates that the maximum retard position is reached—the detent pawl 12 then blocks the gear wheel 2 against backward rotation by the force of the compression spring 13.

Figure 8:
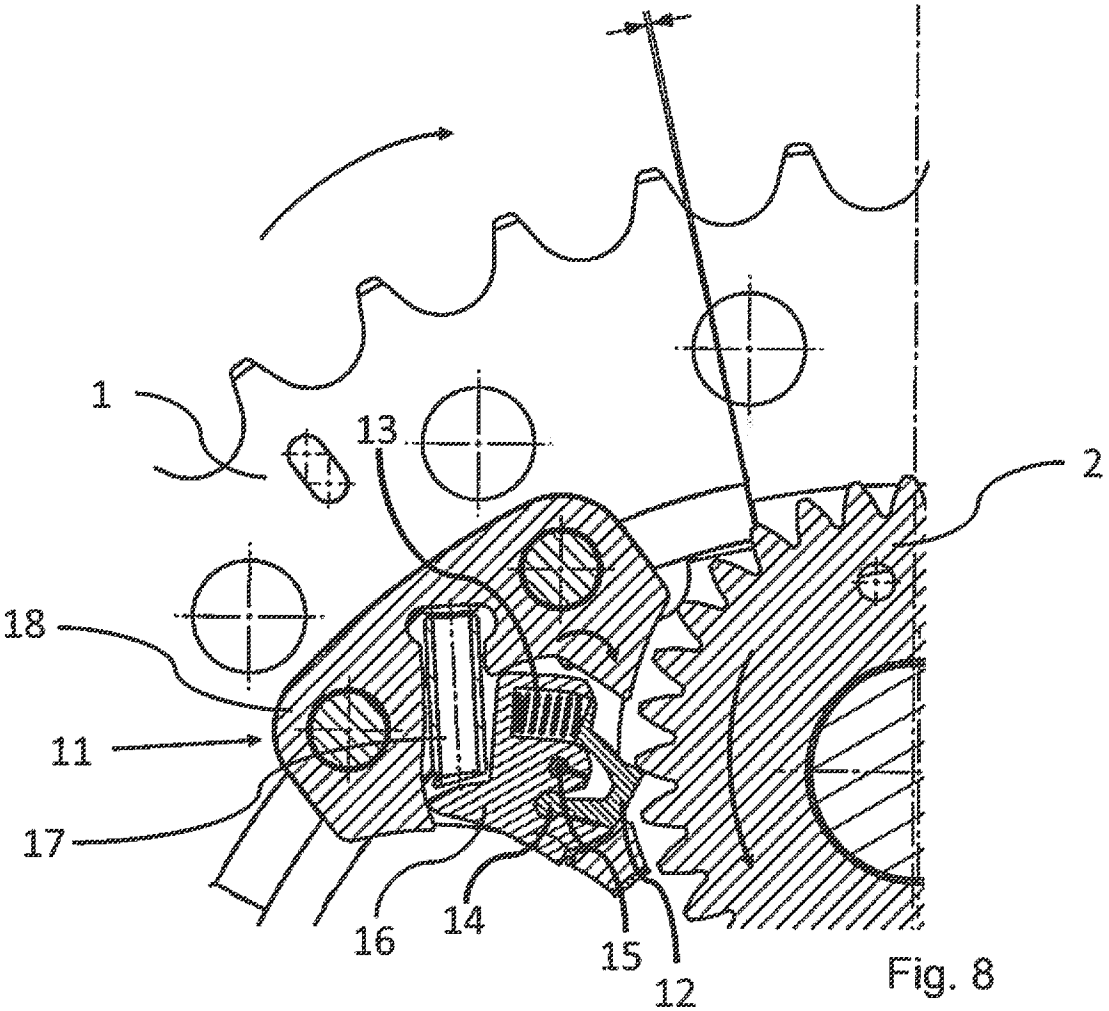
FIGS. 8 and 9 are similar partial enlarged views showing release of the pivotal detent pawl of the failsafe mechanism from the blocking position.
Figure 9:
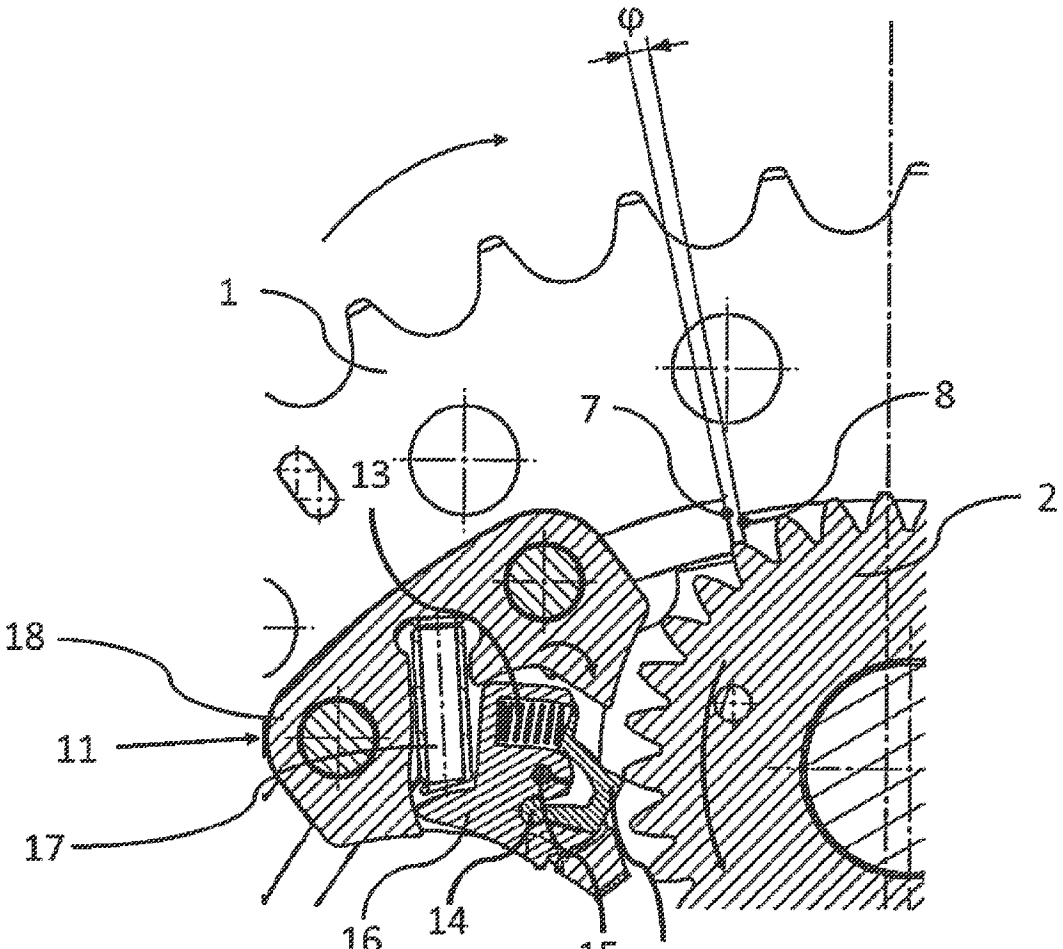

However, the blocking of the gearwheel 2 against backward rotation acts only up to a certain torque. Owing to the leverages of the pivot bearings 14, 15 in conjunction with the characteristic curves of the compression springs 13, 17, the detent pawl 12 can counteract in a blocking way a rotation of the gear wheel 2 in the opposite direction up to a specific torque. When a specific torque is exceeded, the detent pawl 12 pivots the bearing part 16 clockwise counter to the compression spring 17 and thus frees the gearwheel 2 again. The rotation of the gearwheel 2, which then causes the maximum retard position to be left, is illustrated in FIGS. 8 and 9 by the directional arrow.

The torque which is to be exerted in order to leave again the maximum retard position fixed by the detent pawl 12 is selected, by appropriate dimensioning of the elements of the failsafe mechanism 11 which are described, such that this position can be left only when the adjusting drive motor (electric motor) is intact and driving, that is to say the latter causes the backward rotation of the gearwheel 2 via the central gearing input wheel 3. The alternating torques on the camshaft which take effect during operation are not sufficient because of the high reduction of the gear and the lack of drive torque of the motor.

LIST OF REFERENCE SIGNS

1 drive wheel, chain wheels drive side
2 gear wheel, planet wheel
3 gear input wheel
4 carrier plate
5 gear output, output side
6 central screw, connection camshaft
7 limit stop
8 limit stop
9 limit stop
10 limit stop
11 blocking device, failsafe mechanism
12 detent pawl
13 compression spring (detent pawl)
14 pivot bearing (detent pawl 12)
15 pivot bearing (bearing part 16)
16 bearing part
17 compression spring (bearing part 16)
18 base part (failsafe mechanism)

What is claimed is:

1. A camshaft adjuster for an internal combustion engine, composed of an adjusting gear designed as a triple-shaft gear, with a drive wheel which is driven from the internal combustion engine and via which a drive torque for a camshaft is introduced, of a gear output coupled fixedly in terms of rotation to the camshaft, and of a gear input wheel which is coupled to a drive motor and via which an adjusting torque causing a relative rotation between the drive wheel and the gear output is introduced into the adjusting gear, wherein a failsafe mechanism is provided which causes blocking of the adjusting gear and which, in the event of the absence of the adjusting torque being introduced via the gear input wheel, acts upon a gear element located between the drive wheel and the gear output, and wherein the failsafe mechanism includes a detent pawl which is prestressed by a spring and which cooperates with the gear element which is located between the drive wheel and the gear output.

2. The camshaft adjuster as claimed in claim 1, wherein the failsafe mechanism holds the adjusting gear in one of a pair of end positions which correspond to a maximum advance position and a maximum retard position of the camshaft.

3. The camshaft adjuster as claimed in claim 1, wherein the failsafe mechanism is assigned an actuator that can be actuated by which the blocking can be cancelled.

4. The camshaft adjuster as claimed in claim 1, wherein the failsafe mechanism is releasable through the application of a minimum adjusting torque to be applied by the gear input wheel.

5. The camshaft adjuster as claimed in claim 1, wherein the detent pawl prestressed by the spring is attached to a base part that is coupled fixedly in terms of rotation to the drive wheel or to the gear output.

6. The camshaft adjuster as claimed in claim 1, wherein the detent pawl is pivotably attached to a bearing part, the bearing part is tensioned by a further spring and is mounted pivotably with respect to a base part, and wherein the base part is fixed for rotation with the drive wheel or the gear output.

7. The camshaft adjuster as claimed in claim 1 wherein the gear element is a gearwheel meshed with the gear input wheel and an internal gear formed on the drive wheel, wherein the gearwheel is mounted on a carrier plate which is fixed for rotation with the gear output, wherein the failsafe mechanism further includes a base part fixed for rotation with the drive wheel, a bearing part pivotably mounted to the base part, and a second spring biasing the bearing part relative to the base part, and wherein said detent pawl is pivotably mounted to the bearing part with the spring acting between the detent pawl and the bearing part.

8. The camshaft adjuster as claimed in claim 7 wherein the drive wheel includes a first drive-side limit stop arranged to cooperate with a first camshaft-side limit stop formed on one of the carrier plate and the gear output so as to define a maximum retard position of the gear output relative to the drive wheel, and wherein the drive wheel includes a second drive-side limit stop arranged to cooperate with a second camshaft-side limit stop formed on one of the carrier plate and the gear output so as to define a maximum advance position of the gear output relative to the drive wheel.

9. The camshaft adjuster as claimed in claim 8 wherein movement of the gear output toward the maximum retard position in response to the adjusting torque being applied by the drive motor to the gear input wheel in a first rotary direction causes gear teeth on the gearwheel to engage and pivot the detent pawl in opposition to the biasing of the spring, and wherein the spring biases the detent pawl into a blocking position relative to the gear teeth on the gearwheel when the gear output is located in the maximum retard position.

10. The camshaft adjuster as claimed in claim 9 wherein subsequent application of the adjusting torque by the drive motor to the gear input wheel in a second rotary direction causes the torque applied by the gear teeth of the gearwheel on the detent pawl to cause the detent pawl to forcibly pivot the bearing part in opposition to the biasing of the second spring and move the detent pawl to a non-blocking position.

11. A camshaft adjuster operably disposed between the crankshaft and the camshaft of an internal combustion engine and configured as a triple-shaft adjusting gear, comprising:

a drive wheel driven by the crankshaft and having an internal gear;

a central gear input wheel;

a gearwheel meshed with the internal gear and the gear input wheel;

a gear output coupled for rotation with the camshaft, the gear output supporting the gearwheel;

an adjusting motor providing an adjusting torque for rotatably driving the central gear input wheel to cause the gear output to rotate relative to the drive wheel between a maximum retard position and a maximum advance position; and a failsafe mechanism operable for blocking the adjusting gear in absence of the adjusting torque being provided to the gear input wheel by a blocking device acting on the gearwheel, wherein the blocking device includes a detent pawl biased by a spring toward a blocking position and configured to engage gear teeth on the gearwheel when located in the blocking position.

12. The camshaft adjuster of claim 11 wherein the blocking device is configured to hold the adjusting gear in one of the maximum advance position and the maximum retard position of the camshaft relative to the crankshaft.

13. The camshaft adjuster of claim 11 wherein the failsafe mechanism is assigned an actuator operable to move the detent pawl from the blocking position to a released position to cancel the blocking of the adjuster gear.

14. The camshaft adjuster of claim 11 wherein the failsafe mechanism is releasable through the application of a minimum adjusting torque applied to the gear input wheel by the adjusting motor.

15. The camshaft adjuster of claim 11 wherein the failsafe mechanism further includes a base part fixed to the drive wheel, a bearing part pivotably mounted to the base part with the detent pawl being pivotably mounted to the bearing part, and a second spring disposed between the base part and the bearing part for cooperating to hold the detent pawl in the blocking position.

16. The camshaft adjuster of claim 15 wherein movement of the gear output toward the maximum retard position in response to the adjusting torque being applied by the adjusting motor to the gear input wheel in a first rotary direction causes gear teeth on the gearwheel to engage and pivot the detent pawl in opposition to the biasing of the spring, and wherein the spring biases the detent pawl into the blocking position relative to the gear teeth on the gearwheel when the gear output is located in the maximum retard position.

17. The camshaft adjuster of claim 16 wherein subsequent application of the adjusting torque by the adjusting motor to the gear input wheel in a second rotary direction causes the torque applied by the gear teeth of gearwheel on the detent pawl to cause the detent pawl to forcibly pivot the bearing part in opposition to the biasing of the second spring and move the detent pawl to a non-blocking position.

18. A camshaft adjuster for adjusting a phase angle between a crankshaft and a camshaft in an internal combustion engine, the camshaft adjuster comprising:

an adjusting gear configured as a triple-shaft gear and including a drive wheel driven by the crankshaft, for introducing a drive torque to the camshaft, a gear output fixedly coupled to the camshaft, and a gear input wheel coupled to an adjusting motor and operable to introduce an adjusting torque into the adjusting gear which causes relative rotation between the drive wheel and the gear output; and a failsafe mechanism operable for selectively blocking the adjusting gear by acting upon a gear element located between the drive wheel and the gear output in an absence of the adjusting torque being introduced via the gear input wheel, wherein the failsafe mechanism includes a detent pawl which is biased by a spring and which cooperates with the gear element located between the drive wheel and the gear output, and wherein the detent pawl is attached to a base part that is coupled fixedly in terms of rotation to the drive wheel or to the gear output.

* * * * *